US005308061A

United States Patent [19]

Bernhardt

[11] Patent Number: 5,308,061

[45] Date of Patent: May 3, 1994

[54] FINGER INSERT FOR A BOWLING BALL

[75] Inventor: David A. Bernhardt, Utica, Mich.

[73] Assignee: Davalor Mold Corporation, Mt. Clemens, Mich.

[21] Appl. No.: 988,763

[22] Filed: Dec. 10, 1992

Related U.S. Application Data

[60] Continuation-in-part of Ser. No. 836,126, Feb. 14, 1992, Pat. No. 5,176,378, which is a division of Ser. No. 648,217, Jan. 31, 1991, Pat. No. 5,123,644, which is a division of Ser. No. 513,443, Apr. 23, 1990, Pat. No. 5,007,640, which is a continuation-in-part of Ser. No. 498,009, Mar. 23, 1990, Pat. No. 5,002,276.

[51] Int. Cl.[5] ..... A63B 43/02

[52] U.S. Cl. ..... 473/127; 273/128 A

[58] Field of Search ..... 273/63 A, 63 B, 63 R, 273/65 EG, 63F

[56] References Cited

U.S. PATENT DOCUMENTS

| | | | |
|---|---|---|---|
| 189,674 | 4/1977 | Woods | 273/63 A |
| 447,011 | 2/1991 | Harman | 273/63 A |
| 580,207 | 4/1997 | Boemermann et al. | 273/63 A |
| 626,584 | 6/1999 | Wilmerling | 273/63 A |
| 673,688 | 5/1901 | Pickett | 273/63 A |
| 950,838 | 3/1910 | Cavanagh | 273/63 A |
| 2,273,199 | 2/1942 | Hilton et al. | 273/63 A |
| 2,274,522 | 2/1942 | Bomze | 273/63 A |
| 2,347,881 | 5/1944 | Cahen | 273/63 A |
| 2,460,385 | 2/1949 | Hausman | 273/63 A |
| 2,485,471 | 10/1949 | Bates | 273/63 A |
| 2,646,985 | 7/1953 | Nagy et al. | 273/63 A |
| 2,708,578 | 5/1955 | Mitchell | 273/63 A |
| 2,843,382 | 7/1958 | Ross | 273/63 A |
| 3,078,097 | 12/1959 | Mitchell | 273/63 |
| 3,774,909 | 11/1973 | Linden | 273/63 A |
| 3,784,198 | 1/1974 | Bach | 273/63 A |
| 3,804,412 | 4/1974 | Chetirko | 273/63 A |
| 4,247,102 | 1/1981 | Seyler | 273/63 B |
| 4,265,642 | 5/1981 | Mir et al. | 55/85 |
| 4,289,312 | 9/1981 | Heimbigner | 273/63 A |
| 4,358,112 | 11/1982 | Straborny | 273/63 A |
| 4,381,863 | 5/1983 | Norman | 273/63 A |
| 4,416,452 | 11/1983 | Heimbigner | 273/63 A |
| 4,432,546 | 2/1984 | Allen, Jr. | 273/63 A |
| 4,530,502 | 7/1985 | Yamane | 273/63 A |
| 4,560,162 | 12/1985 | Miller | 273/63 B |
| 4,561,654 | 12/1985 | Haza | 273/63 B |
| 4,569,520 | 2/1986 | Yamane | 273/63 A |
| 4,585,230 | 4/1986 | Martin | 273/63 A |
| 4,623,149 | 11/1986 | Herman | 273/63 A |
| 4,632,396 | 12/1986 | Taylor | 273/63 A |
| 4,699,380 | 10/1987 | Mace | 273/63 A |
| 4,773,645 | 9/1988 | Todd et al. | 273/63 A |
| 4,778,178 | 10/1988 | Haza | 273/63 B |
| 5,007,640 | 4/1991 | Bernhardt | 273/63 A |

OTHER PUBLICATIONS

Advertisement by Pro Sports Systems, Inc., entitled "Manufacturers of the Grips that Legends Use."

*Primary Examiner*—George J. Marlo

*Attorney, Agent, or Firm*—Harnessm, Dickey & Pierce

[57] ABSTRACT

A finger hole insert for a bowling ball which is formed of a resilient tubular body and is adapted to be inserted into a finger hole. The insert has an oblong cylindrical inner wall surface defining finger openings at opposite terminal ends of the insert which are sized to permit insertion of a bowler's finger therein. The finger openings have thickened parallel planar finger pads therein adapted for cushioning the bowler's finger. The finger openings also have opposed arcuate finger pads for augmenting the spin and lift applied during delivery of the bowling ball. In this manner, the bowler has a preferential choice between the two functions provided by each finger opening of the insert.

8 Claims, 3 Drawing Sheets

FINGER INSERT FOR A BOWLING BALL

This application is a continuation in part of Ser. No. 07/836,126 filed Feb. 14, 1992, now U.S. Pat. No. 5,176,378, which was a divisional of Ser. No. 07/648,217, filed Jan. 13, 1991, now U.S. Pat. No. 5,123,648, which was a divisional of Ser. No. 07/513,443 filed Apr. 23, 1990, now U.S. Pat. No. 5,007,640, which was a continuation in part of Ser. No. 07/498,009, filed on Mar. 23, 1990, now U.S. Pat. No. 5,002,276.

BACKGROUND AND SUMMARY OF THE INVENTION

The present invention relates generally to tubular inserts for a bowling ball and, more particularly, to an improved finger grip insert adapted to be inserted into a finger hole of a bowling ball to enhance a bowler's grip of the ball during delivery.

In bowling it is the object of the bowler to knock down as many pins as possible. Many successful bowlers throw a ball which has a pronounced hook since, historically, this type of delivery generates the most pin action. To make a ball hook, it is necessary to maintain contact between the fingers and the ball during delivery to impart a "lifting" action on the ball.

Finger hole inserts are used by bowlers to augment the lift and spin imparted to the ball during release. Likewise, some finger hole inserts are designed to provide the bowler with greater control (i.e. "feel") of the ball. In general, finger inserts allow the bowler's fingertips to stay in contact with the ball while providing a desired function such as enhancing the "feel" or adding "lift" to the bowler's delivery.

Various tubular finger inserts are known in the art. However, conventional finger inserts typically provide a single function (i.e. extra "lift") and are generally configured to have only one open end.

Accordingly, it is a primary object of the present invention to provide a "dual function" finger insert which offers the bowler a choice between two distinct functional characteristics. In addition, the improved finger grip insert of the present invention has first and second finger openings provided at opposite ends thereof.

It is another object of the present invention to provide an injection molded finger hole insert which is economical to manufacture and is simple in construction. The aforementioned invention may be permanently or removably secured within a finger hole of a bowling ball so as to permit preferential use of either "functional" characteristic of the insert. The resilient finger insert is adapted for securement within a finger hole with the finger opening of the insert being substantially flush with the exterior surface of the bowling ball.

According to one embodiment, the first finger opening has at least one ridge-like projection which enables the bowler to add "lift" and "spin" to his delivery of the bowling ball. The second finger opening has a thickened finger pad to permit the bowler to joy improved "feel" of the bowling ball by increasing the contact area between the bowler's finger and the insert. The thickened finger pad is configured either as a planar surface or as an arcuate surface. In this manner, depending on the bowler's preference, the finger insert is reversible so that either one of the two ends may be used by the bowler.

In accordance with another embodiment, an improved "dual function" finger grip insert has an inner wall surface which is substantially coaxial with the outer wall surface and which defines generally circular first and second finger openings. The inner wall surface is textured to enhance the frictional "grip" during delivery of the ball. In addition, the first finger opening has at least one ridge-like projection for providing additional "lift" and "spin" during delivery. The second finger opening is free of any ridge-like projections and is adapted to enhance the bowler's "grip" through increased surface friction provided by the textured inner wall surface.

Pursuant to yet another embodiment, a "dual-function" finger grip insert is disclosed that has a generally oblong finger opening for defining a pair of arcuate finger pads and a pair of thickened planar finger pads. Depending on the bowler's preference, the fingergrip insert can be angularly aligned within the finger hole for offering a choice of either of the "functional" finger pad contours.

These and other objects, features and advantages of the present invention will become more apparent from the following description to one skilled in the art upon reading the following specification taken in connection with the accompanying drawings, which show, for purposes of illustration only, preferred embodiments of the present invention.

DETAILED DESCRIPTION OF THE PREFERRED EMBODIMENT

Figure 1:
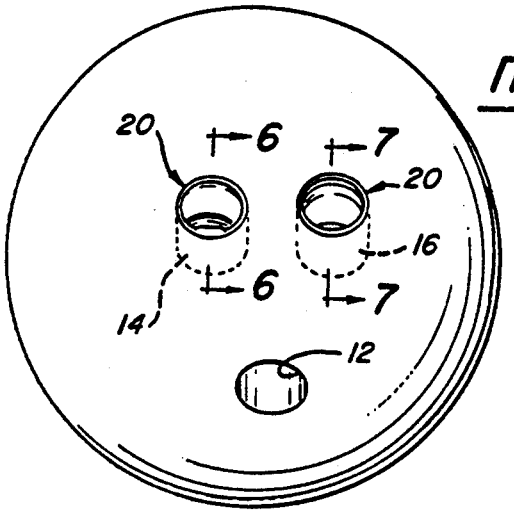
FIG. 1 is a plan view of a bowling ball incorporating improved finger inserts according to an embodiment of the present invention.

Referring now to the drawings, FIG. 1 illustrates a bowling ball 10, having a thumb hole 12 and two finger holes 14 and 16. Finger holes 14 and 16 are shown having, secured therein, reversible "dual function" finger inserts 20 according to the teachings of an embodiment of the present invention. As is apparent, inserts 20 are secured within finger holes 14 and 16 so as to be below or substantially flush with the exterior surface of bowling ball 10. The preferred structure and function of inserts 20 will be shown and described in greater detail in connection with the remaining Figures.

Figure 2:
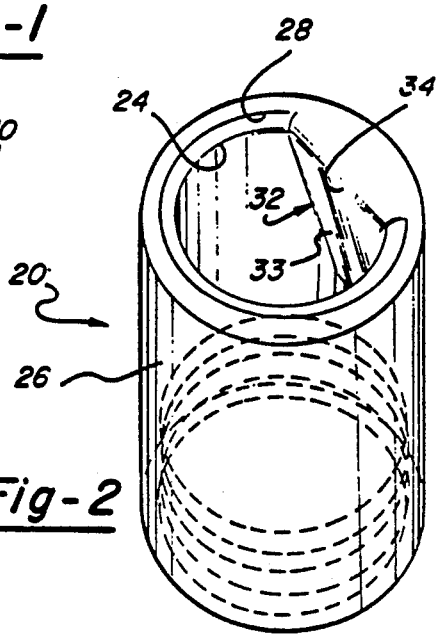
FIG. 2 is a perspective view of an improved "dual function" finger insert

FIG. 2 is a perspective view of finger insert 20. As illustrated, finger insert 20 is a tubular elongated cylindrical body. Preferably, finger insert 20 is an injection molded, right circular hollow body fabricated from a relatively resilient material such as silicon rubber or vinyl. However, it is to be understood, that any resilient material which provides suitable characteristics is within the fair scope of this invention.

Figure 3:
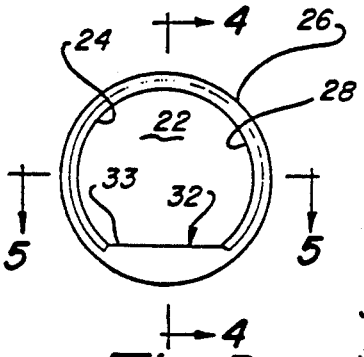
FIG. 3 is an end view of the improved finger insert of FIG. 2.
Figure 4:
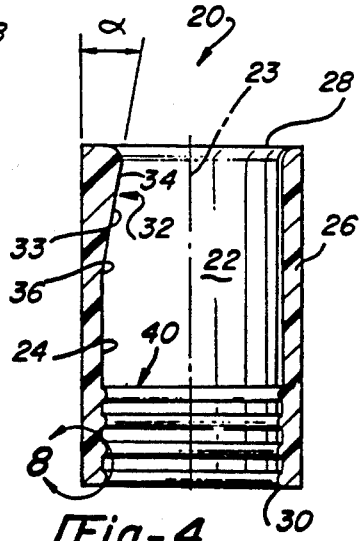
FIG. 4 is a cross-sectional view taken along line 4—4 of FIG. 3.
Figure 5:
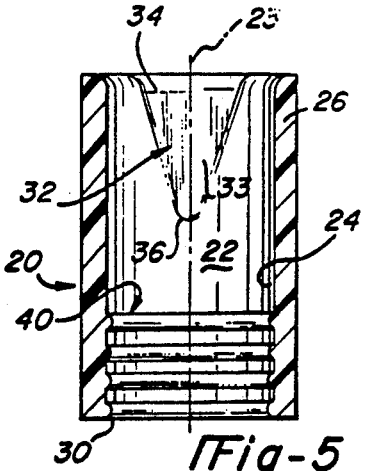
FIG. 5 is a cross-sectional view taken along line 5—5 of FIG. 3.

Insert 20 has an axially extending aperture or bore 22 which is concentric with a central axis 23 of insert 20 and which is provided to receive a bowler's fingertip therein. Bore 22 is, preferably, circular in cross-section, extends completely through insert 20, and more preferably has a relatively smooth surface. More specifically, bore 22 is defined by an inner wall surface 24 which is in substantially coaxial relation to outer wall surface 26 as seen in FIG. 3. Likewise, outer wall surface 26 is circular in cross-section and preferably has a relatively smooth surface. The wall portion formed between cylindrical outer wall surface 2 and cylindrical inner wall surface 24 is of a substantially constant thickness. Bore 22 extends completely through insert 20 to define a first finger opening 28 and a second finger opening 30 which are provided at opposite terminal ends thereof.

Referring now to FIGS. 4 through 8, the function and structure of insert 20 will be described in greater detail. Adjacent first finger opening 28 is a thickened "cushioning" surface 32 defining a finger pad. In general, a thickened portion of inner wall surface 24 defines finger pad 32 while the remainder of the wall portion adjacent and abutting finger pad 32 is cylindrical and of constant wall thickness. More specifically, finger pad 32 is generally triangular in configuration with its thickened base 34 located in close proximity to the planar terminal end of first finger opening 28. The apex 36 of the triangular finger pad 32 extends toward second finger opening 30 and terminates approximately midway through insert 20. The planar surface 33 of finger pad 32 is preferably tapered so as to terminate at apex 36 by blending into the constant thickness wall portion previously described. The thickness of finger pad 32 gradually decreases from its base 34 toward apex 36. Preferably, the tapered planar surface 33 of finger pad 32 has an angular taper ($\alpha$) of about 8° relative to outer wall surface 26.

Triangular finger pad 32 functions to enhance the "feel" and provide additional power to the bowler's delivery as a result of generating additional direct contact between the bowler's fingertip and inner wall surface 24 of finger insert 20. In addition, finger pad 32 "guides" the release of the fingers from insert 20 while acting as a reference with respect to the bowler's fingers during gripping and releasing of bowling ball 10. Insert 20 is preferably inserted into a finger hole in bowling ball 10 such that the bowler's fingertips will be adjacent finger pad 32. In this manner, finger pad 32 minimizes slippage of the bowling ball during delivery.

Figure 8:
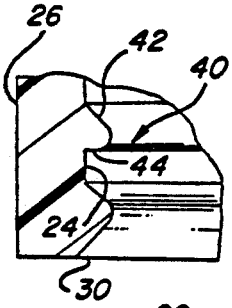
FIG. 8 is an enlarged view of a portion of FIG. 4.

In close proximity to the terminal end of second finger opening 30 at least two, and preferably four, ridge-like projections or ribs 40 are provided which extend around the periphery of inner wall surface 24. Preferably, ribs 40 are evenly spaced in longitudinal relation and are provided with a generally rounded contour. As shown in FIG. 8, ribs 40 are generally crescent-shaped being defined by a tapered major surface 42 and a rounded edge 44 which terminates at inner wall surface 24.

When finger insert 20 is installed in a finger hole such that second finger opening 30 is below or in generally flush relation to the external surface of bowling ball 10, a second "function" is provided as a preferential choice to the bowler. In practice, it has been found that the use of ridge-like projections 40 enhance the gripping force of the fingertip inserted within finger insert 20. Ribs 4 greatly increase the "lift" which may be applied to ball 10 by the bowler resulting in ball 10 generating a more pronounced hook. More particularly, the bowler's fingertips hook around the peripherally extending ribs to grip bowling ball 10. Likewise, ribs 40 minimize slippage of the bowling ball during delivery. The inner wall surface 24 at regions below ribs 40 has a relatively smooth texture so that the frictional gripping action at these regions is the result of the frictional characteristic of the insert material. In this manner, a bowler may throw a more pronounced hook to generate increased pin action.

Figure 6:
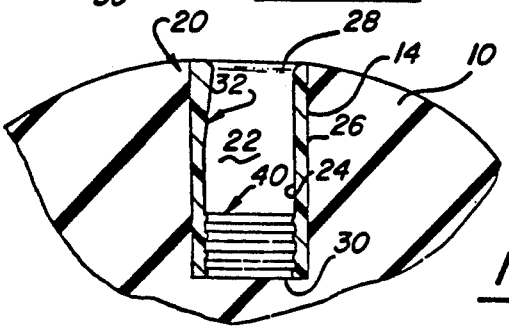
FIG. 6 is a cross-sectional view taken along line 6—6 of FIG. 1.
Figure 7:
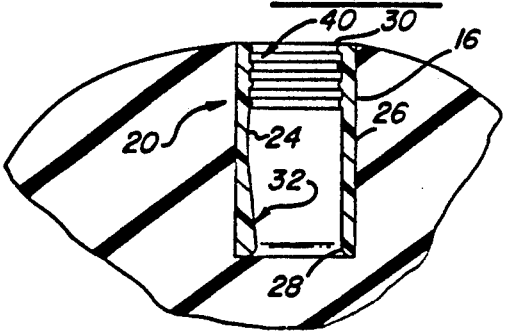
FIG. 7 is a cross-sectional view taken along line 7—7 of FIG. 1.

In reference to FIGS. 6 and 7 the "reversibility" and dual "functional" characteristics of the first embodiment of the instant invention are illustrated. Specifically, FIG. 6 illustrates finger insert 20 mounted in finger hole 14 such that first finger hole 28 is orientated to be adjacent and generally flush with the exterior surface of ball 10. Alternatively, in reference to Figure 7, finger insert 20 is illustrated installed in a "reversed" orientation within finger hole 16 of bowling ball 10. It is contemplated that finger insert 20 may be used in any combination of orientations in either finger hole 14 and 16. Additionally, for purposes of the present invention, the thumb is to be construed as a finger, that is, insert 20 may also be sized for installation within thumb hole 12 of ball 10.

Figure 9:
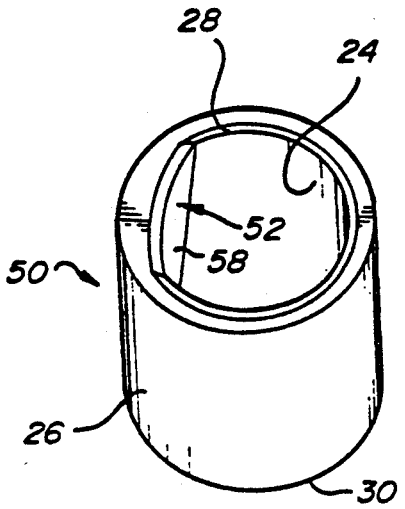
FIG. 9 is a perspective view of another embodiment of an improved "dual function" finger insert.
Figure 10:
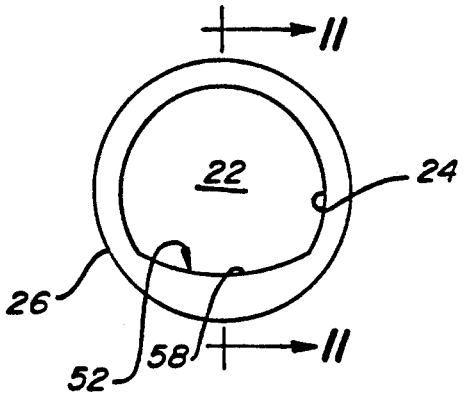
FIG. 10 is an end view of FIG. 9.
Figure 11:
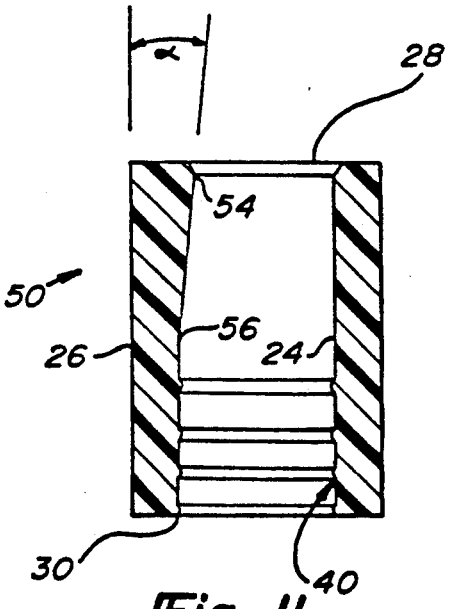
FIG. 11 is a cross-sectional view taken along line 11—11 of FIG. 10.

Referring now to FIGS. 9 through 11, another embodiment of a reversible "dual function" finger insert 50 is illustrated. Finger insert 50 is substantially similar to that herebefore described in reference to the first embodiment with the exception that the tapered thickened "cushioning" finger pad 52 has a generally arcuate surface 58. In general, arcuate surface 58 is a generally thickened portion of inner wall surface 24 for defining finger pad 52 while the remainder of the wall portion adjacent and abutting finger pad 52 is generally cylindrical and of constant wall thickness. Finger pad 52 is generally triangular with its thickened base 54 located in close proximity to the terminal end of first finger opening 28. The apex 56 of the arcuate finger pad 52 extends toward second finger opening 30 and terminates approximately midway through insert 50. The arcuate surface 58, adapted to engage a bowler's fingertip, is preferably tapered so as to terminate at apex 56 by blending into the constant thickness wall portion previously described. The thickness of finger pad 52 gradually decreases from its base 54 toward apex 56. Preferably, the arcuate surface 58 of finger pad 52 has an angular taper ($\alpha$) of about 8° relative to outer wall surface 26.

In particular, arcuate surface 58 is defined by an arc of a predetermined radius interconnecting with the generally circular inner wall surface 24. The arc covers approximately 90° of the 360° cylindrical inner wall surface. As is apparent the arc has a radius which is greater than the radius of bore 22 associated with cylindrical inner wall surface 24. As previously described, finger pad 52 "guides" the release of the fingers from first finger opening 28 of insert 50 while acting as a reference with respect to the bowler's fingers during gripping and releasing of the bowling ball. Insert 50 is preferably inserted into a finger hole of a bowling ball such that the bowler's fingertip will be adjacent finger pads 52 to minimize slippage of the bowling ball during delivery.

Finger insert 50 also includes at least two, three, and preferably four, ridge-like projections or ribs 40 extending around the periphery of inner wall surface 24 and in close proximity to the terminal end of second finger opening 30. Ribs 40 are evenly spaced in longitudinal relation and are provided with a generally rounded contour. Preferably, ribs 40 are substantially similar in configuration to that illustrated in FIG. 8. More preferably, inner wall surface 24 and arcuate surface 58 of finger pad 52 are relatively smooth such that the frictional gripping action associated therewith are a direct result of the frictional characteristics of the insert material. As is apparent, each finger opening associated with finger insert 50 provides a "function" which can be preferential to the bowler.

Figure 12:
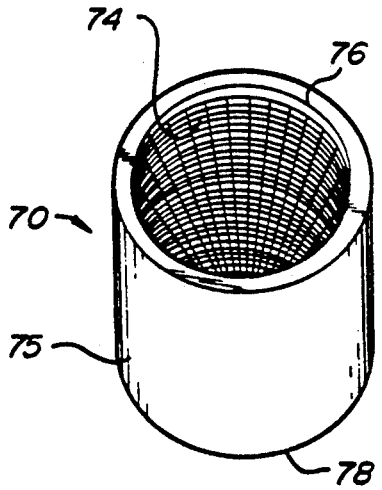
FIG. 12 is a perspective view of a further embodiment of a "dual function" finger insert.
Figure 13:
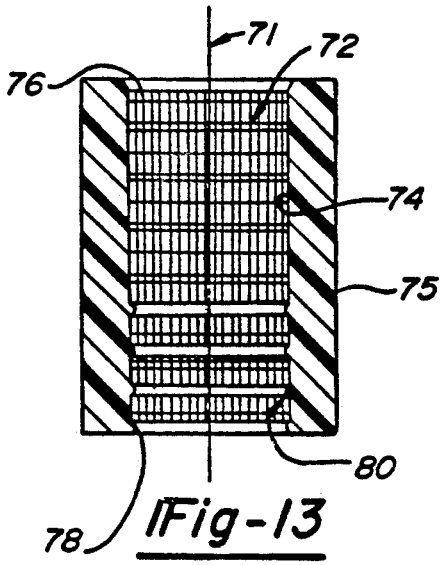
FIG. 13 is a cross-sectional view taken along line 13—13 of FIG. 12.
Figure 14:
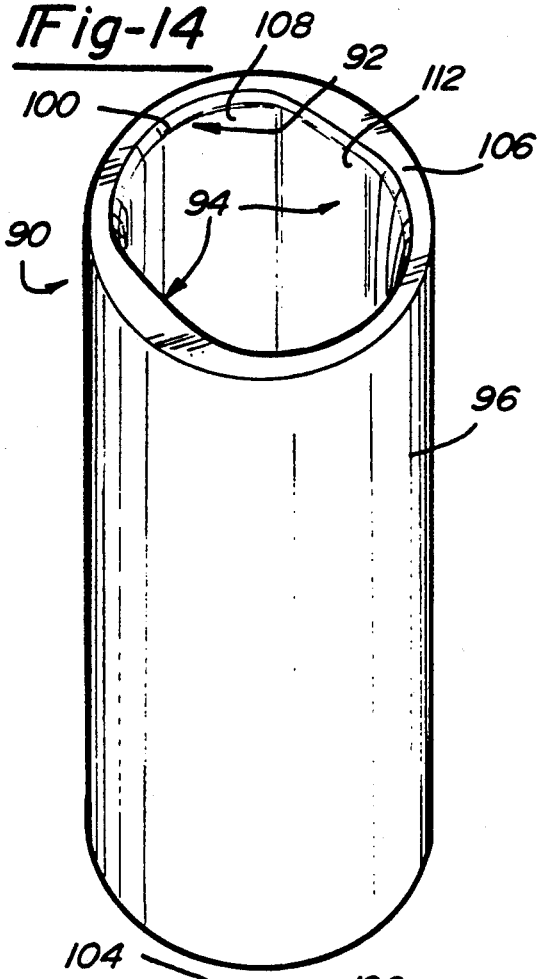
FIG. 14 is a perspective view of yet another embodiment of an improved "dual-function" finger insert.
Figure 15:
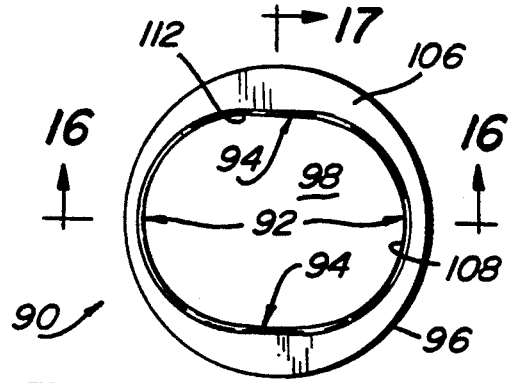
FIG. 15 is an end view of the finger insert shown in FIG. 14.
Figure 16:
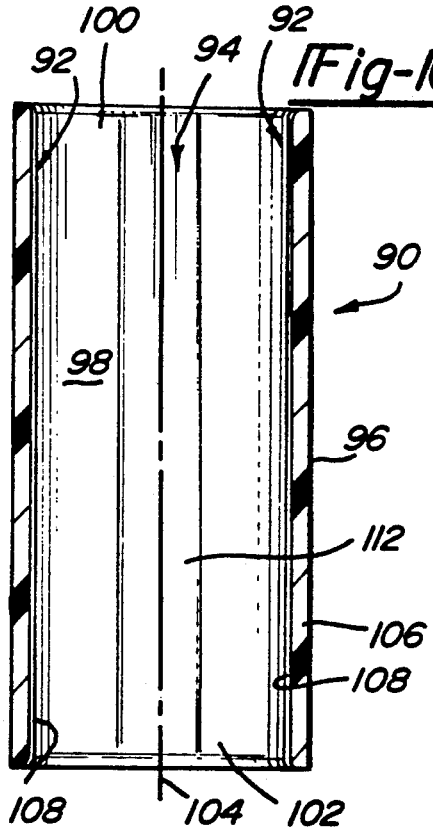
FIG. 16 is a cross-sectional view taken along line 16—16 of FIG. 14.
Figure 17:
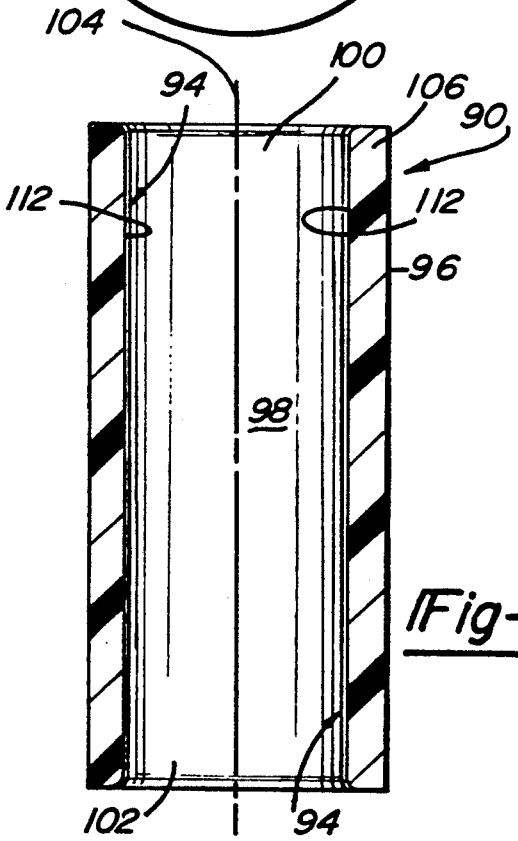
FIG. 17 is a cross-sectional view taken along line 17—17 of FIG. 14.
Figure 18:
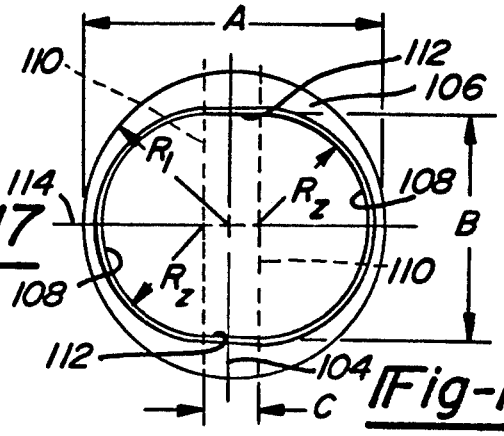
FIG. 18 is an end view, similar to FIG. 15, showing the oblong finger opening in greater detail.

Referring now to FIGS. 12 and 13, another embodiment of a reversible "dual function" finger insert is illustrated. In particular, FIG. 12 illustrates finger insert 70 as having an axially extending bore 72 which is concentric with a central axis 71 of insert 70. Bore 72 is circular in cross-section and extends completely through insert 70. More specifically, bore 72 is defined by inner wall surface 74 which is coaxial in relation to outer wall surface 75. Outer wall surface 75 is circular in cross-section and has a relatively smooth surface. The wall portion formed between the cylindrical outer wall surface 75 and the cylindrical inner wall surface 74 is of substantially constant thickness. Bore 72 extends completely through insert 70 to define first and second finger openings 76 and 78, respectively, at opposite ends thereof.

Finger insert 70 is provided with a generally roughly textured inner wall surface 74 relative to the outer wall surface 75. The non-smooth texture of inner wall surface 74 provides increased frictional interaction between a bowler's fingertip and inner wall surface 74. Succinctly, the textured inner wall surface 74 augments the frictional characteristic of the insert material itself. The textured surface is preferably continuous along the entire length of inner wall surface 74. While the textured inner wall surface 74 is illustrated a having a finely grooved cross-hatching, any suitable non-smooth surface, such as knurled, angled, nubs, bumps or the like, is applicable to the present invention.

First finger opening 76 of insert 70 is provided without ridges or a cushioning pad such that the bowler's fingertip directly engage the generally circular inner wall surface 74. The second finger opening 78 includes at least two, three, and preferably four, ridge-like projections or ribs 80 extending around the textured inner wall surface 74. Ribs 80 are evenly spaced in longitudinal relation and are provided with a generally rounded contour. Ribs 80 are generally crescent shaped being preferably defined by the configuration heretobefore illustrated in reference to FIG. 8.

The outside diameter of finger inserts 20, 50 and 70 are preferably uniform regardless of the bowler's finger size so that the finger inserts may be fit interchangeably into standardized finger and thumb holes. More specifically, finger holes 14, 16 for most bowling balls are commonly drilled to have a diameter of approximately 31/32" or 1-1/32" and a depth of about 1⅛" to 1⅜". Likewise, thumb holes 12 are typically drilled to a similar depth, but have slightly larger diameters of approximately 1⅝" or 1¼". By maintaining a uniform outside diameter for the finger inserts, the size of thumb hole 12 and finger holes 14, 16 can be standardized thereby minimizing problems associated with custom drilling of such holes. As such, the disclosed finger inserts are preferably available in a set, wherein each finger insert has a differently sized axial bore which corresponds to a preselected finger size. More preferably, the finger inserts are available with central bores that vary in diameter from about 19/32" to about 29/32" at increments of 1/32". Such incremental changes in finger sizes are compensated for by increasing the constant wall thickness defined between the outer wall surface and the inner wall surface. In this manner, regardless of finger size, the thickness of finger pads 32 and 52 relative to the inner wall surface is uniform for all inserts. However, it is to be understood that the finger inserts of the present invention can be fabricated to any desired length or have any central bore diameter which is required to meet the demands of bowlers.

With particular reference now to FIGS. 14 through 18, yet another embodiment of a "dual-function" finger insert 90 is illustrated. In general, finger insert 90 can be angularly aligned within one of finger holes 14, 16 and/or thumb hole 12 to preferentially offer the bowler "functional" use of either an arcuate finger pad 92 or a thickened planar finger pad 94. More particularly, finger insert 90 is an elongated right circular hollow member having a relatively smooth outer wall surface 96 and an axially extending bore 98 which defines first and second finger openings 100 and 102, respectively, at opposite ends of finger insert 90. Functionally, thickened planar finger pads 94 enhance the "feel" by providing increased contact area with the bowler's fingertip, while concomitantly guiding the release of the fingers from finger insert 90. Likewise, when one of arcuate finger pads 92 is being used, the planar surfaces of planar finger pads 94 are aligned to engage the lateral edges of the bowler's fingertip, thereby guiding the release of the fingertips from axial bore 98.

According to the embodiment shown, axial bore 98 has an oblong surface profile which is substantially coaxial with outer wall surface 96 with respect to a central longitudinal axis 104 of finger insert 90. In deviating from the previously-disclosed embodiments, the wall portion 106 formed between the inner wall surface of oblong bore 98 and circular outer wall surface 96 has a variable cross-sectional thickness, particularly between planar thickened finger pad 94 and arcuate finger pad 92. As noted, outer wall surface 96 of finger insert 90 is preferably circular, as indicated by a radius $R_1$ having its origin on longitudinal axis 104. In addition, the inner wall surface of oblong bore 98 is shown to include a pair of elongated arcuate wall surfaces 108 each having a second radius $R_2$ with its respective origin aligned on a longitudinal axis 110 that is parallel to and laterally offset from longitudinal axis 104. Moreover, the laterally-spaced terminal ends of elongated arcuate wall surfaces 108 are interconnected by a pair of elongated planar wall surfaces 112. Thus, adjacent each finger opening 100 and 102, a pair of arcuate finger pads 92 are defined by arcuate wall surfaces 108 while a pair of thickened planar finger pads 94 are defined by planar wall surfaces 112. As best seen from the cross-sectional views shown in FIGS. 16 and 17, elongated arcuate wall surfaces 10 and planar wall surfaces 112 extend across the entire length of axial bore 98 in finger insert 90.

According to the preferred embodiment shown, the longitudinal axis 110 for each arcuate wall surface 108 is equally offset along a transverse plane 114 with respect to longitudinal axis 104. Preferably, the second radius $R_2$ for each of arcuate wall surfaces 108 is identical and extends 180° for defining semi-cylindrical wall surfaces. As such, planar wall surfaces 112 are adapted to extend parallel to transverse plane 114 as well as to each other. However, it will be appreciated that each arcuate wall surface 108 may have a different second radius $R_2$, differing amounts of offset from longitudinal axis 104 and/or varying angular chord lengths to produce finger inserts having arcuate finger pads 92 and planar finger pads 94 that are configured differently than the symmetrical arrangement disclosed. Likewise, while the inner wall surface of oblong bore 98 is shown to be generally smooth, it is contemplated that a textured surface could likewise be employed for providing additional frictional gripping action.

For exemplary purposes only, the following table lists the length "A" and width "B" dimensions associated with an exemplary set of incrementally sized finger inserts 90. As can be seen from FIG. 18, the width "B" is equal to twice the magnitude of the second radius $R_2$. Likewise, the length "A" is equal to twice the radius, $R_1$.

| Outside Diameter "$R_1$" (Inches) | "A" (Inches) | "B" (Inches) |
|---|---|---|
| 1⅛ | 51/64 | 45/64 |
| 1⅛ | 13/16 | 23/32 |
| 1⅛ | 53/64 | 47/64 |
| 1⅛ | 27/32 | 3/4 |
| 1⅛ | 55/64 | 49/64 |
| 1⅛ | 7/8 | 25/32 |
| 1⅛ | 57/64 | 51/64 |
| 1⅛ | 29/32 | 13/16 |
| 1⅛ | 59/64 | 53/64 |
| 1⅛ | 15/16 | 27/32 |
| 1⅛ | 61/64 | 55/64 |
| 1⅛ | 31/32 | 7/8 |
| 1⅛ | 63/64 | 57/64 |
| 1¼ | 1 1/64 | 59/64 |
| 1¼ | 1 1/32 | 15/16 |
| 1¼ | 1 3/64 | 61/64 |
| 1¼ | 1 1/16 | 31/32 |

As is apparent, the overall magnitude of offset between both axes 110 is equal to about 3/32" for each of the incrementally-size combinations disclosed which, in turn, defines the length of planar wall surfaces 112.

Preferably, each of the finger inserts herebefore described is made of an elastomeric and resilient material which can be secured within the finger holes provided in a bowling ball. It is contemplated that the inserts can be permanently secured within a finger hole or may be removably secured therein by any method and materials known to those skilled in the art. Likewise, the insert material should provide a predetermined level of compressibility and deformability to provide comfortable, secure reception of a bowler's finger tip without the risk of "hang-up" upon release of the ball. The reversible finger inserts disclosed herein are preferably injection molded from a relatively resilient material such as silicon rubber or vinyl. Thus, in a simple, yet economical and highly effective manner, the present invention provides a device which achieves a substantial number of beneficial results.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. An insert for a finger hole in a bowling ball comprising a tubular body adapted to be inserted into the finger hole of the bowling ball and having a bore formed therethrough for defining finger openings at opposite terminal ends of said body which are adapted to receive a bowler's fingertip therein, said bore having an oblong edge profile including a pair of elongated and laterally-spaced arcuate, wall surfaces that are interconnected by a pair of parallel elongated planar wall surfaces.

2. The insert of claim 1 wherein each of said elongated arcuate wall surfaces defines an arcuate finger pad, and each of said planar wall surfaces defines a thickened planar finger pad.

3. The insert of claim 2 wherein said tubular body is inserted into the bowling ball such that when one of said finger openings is generally flush with an exterior surface of the bowling ball, the fingertip of the bowler engages one of said arcuate finger pad and said planar finger pad.

4. The insert of claim 2 wherein said arcuate wall surface is semi-cylindrical and said planar wall surfaces are parallel with respect to each other.

5. The insert of claim 4 having a cylindrical outer wall surface that is concentrically aligned on a central axis of said insert, and wherein an axis of each of said semi-cylindrical wall surfaces is offset from said central axis so as to provide said insert with a wall portion having a varying cross-sectional thickness.

6. The insert of claim 5 wherein said cross-sectional thickness of said wall portion is greatest adjacent said planar wall surfaces and least adjacent said semi-cylindrical wall surfaces.

7. A bowling ball assembly comprising:

a bowling ball having at least one finger hole; and a resilient insert disposed within said finger hole, said insert having an inner wall surface defining an oblong aperture aligned coaxial with a central axis of said insert, said aperture extending through said insert to define first and second finger openings on opposite terminal ends thereof and which are sized to received a bowler's finger therein, said oblong aperture having a pair of opposed arcuate finger pads formed on said inner wall surface and a pair of parallel thickened planar finger pads interconnecting said arcuate finger pads, and wherein said insert may be disposed in said finger hole with one of either of said arcuate finger pads and said thickened planar finger pads arranged to engage the bowler's finger.

8. The bowling ball assembly of claim 1 wherein an outer wall surface of said insert and said inner wall surface are concentrically aligned so as to provide said insert with a cylindrical wall portion having a varying wall thickness, said inner wall surface being textured along its entire length to augment the frictional gripping action between the bowler's finger and said insert.

* * * * *